US008500390B2

(12) United States Patent
Wojtyczka et al.

(10) Patent No.: US 8,500,390 B2
(45) Date of Patent: Aug. 6, 2013

(54) FAN CASE WITH RUB ELEMENTS

(75) Inventors: Czeslaw Wojtyczka, Brampton (CA); Andrew Marshall, Grand Valley (CA)

(73) Assignee: Pratt & Whitney Canada Corp., Longueuil ( * ) Notice: Subject to any disclaimer, the term of this patent is extended or adjusted under 35 U.S.C. 154(b) by 706 days.

(21) Appl. No.: 12/783,937

(22) Filed: May 20, 2010

(65) Prior Publication Data

US 2011/0286839 A1 Nov. 24, 2011

(51) Int. Cl.
*F01B 25/16* (2006.01)
*F01D 21/00* (2006.01)

(52) U.S. Cl.
USPC ..... 415/9; 415/173.4; 415/197; 415/200

(58) Field of Classification Search
USPC ..... 415/9, 119, 170.1, 173.1, 173.4, 415/174.4, 196, 197, 200, 220, 214.1, 215.1; 416/174
See application file for complete search history.

(56) References Cited

U.S. PATENT DOCUMENTS

| | | | | |
|---|---|---|---|---|
| 3,874,855 | A | 4/1975 | Legrand | |
| 4,149,824 | A | 4/1979 | Adamson | |
| 4,507,047 | A | 3/1985 | Coons | |
| 4,534,698 | A | 8/1985 | Tomich | |
| 4,547,122 | A | 10/1985 | Leech | |
| 4,699,567 | A | 10/1987 | Stewart | |
| 4,734,007 | A | 3/1988 | Perry | |
| 5,336,044 | A | 8/1994 | Forrester | |
| 5,408,826 | A * | 4/1995 | Stewart et al. | 60/226.1 |
| 5,409,349 | A | 4/1995 | Kulak et al. | |
| 5,413,456 | A | 5/1995 | Kulak et al. | |
| 5,431,532 | A | 7/1995 | Humke et al. | |
| 5,437,538 | A | 8/1995 | Mitchell | |
| 5,447,411 | A | 9/1995 | Curley et al. | |
| 5,482,429 | A | 1/1996 | Penda | |
| 5,485,723 | A | 1/1996 | McCoy et al. | |
| 5,486,086 | A | 1/1996 | Bellia et al. | |
| 5,513,949 | A | 5/1996 | Armstrong | |
| 5,516,257 | A | 5/1996 | Kasprow et al. | |
| 5,516,258 | A | 5/1996 | Newton | |
| 5,885,056 | A | 3/1999 | Goodwin | |
| 6,053,696 | A | 4/2000 | Roberts | |
| 6,394,746 | B1 | 5/2002 | Sathianathan et al. | |
| 6,497,550 | B2 | 12/2002 | Booth | |
| 6,543,991 | B2 | 4/2003 | Sathianathan et al. | |
| 6,575,694 | B1 | 6/2003 | Thompson et al. | |
| 6,638,008 | B2 | 10/2003 | Sathianathan et al. | |
| 6,652,222 | B1 | 11/2003 | Wojtyczka et al. | |
| 6,739,830 | B2 | 5/2004 | Sathianathan et al. | |

(Continued)

*Primary Examiner* — Edward Look
*Assistant Examiner* — Christopher C Williams
(74) *Attorney, Agent, or Firm* — Norton Rose Fulbright Canada LLP

(57) ABSTRACT

A turbofan engine comprising an annular inner wall surrounding tips of the fan blades, a layer of insulating material surrounding the inner wall, and an outer casing including an annular outer wall surrounding the insulating material and concentric to the inner wall and at least two annular rub elements extending radially inwardly from the outer wall through only part of a radial thickness of the layer of insulating material, at least two of the rub elements being in axial alignment with the blade tips at every point around a circumference of the fan, each rub element having a radially inner end spaced apart from the inner wall and made of a material harder than that of the blades, and a containment fabric layer wrapped around a support structure of the outer wall.

20 Claims, 6 Drawing Sheets

U.S. PATENT DOCUMENTS 6,913,436 B2 7/2005 McMillan et al.
7,076,942 B2 7/2006 Schreiber
7,192,243 B2 3/2007 Lawson et al.
7,255,528 B2 8/2007 Stretton
7,338,250 B2 * 3/2008 Martindale et al. ..... 415/9
7,524,161 B2 4/2009 Lawson et al.
2008/0145215 A1 6/2008 Finn et al.
2009/0087309 A1 4/2009 Schreiber
2009/0155044 A1 6/2009 Xie et al.

* cited by examiner

FAN CASE WITH RUB ELEMENTS

TECHNICAL FIELD

The application relates generally to fan case for turbofan gas turbine engines and, more particularly, to a fan blade containment structure therefor.

BACKGROUND OF THE ART

A turbofan fan case includes a containment structure designed to contain a blade released from the fan. Various designs exist, including designs employing composites, which can include a containment fabric layer, such as Kevlar®. The containment fabric is typically wrapped in multiple layers around a relatively thin, often penetrable outer wall of the fan case, positioned between the blades and the fabric layer. Thus, a released blade will penetrate the support case and strike the fabric. The fabric deflects radially, capturing and containing the released blade but largely remains intact. To avoid other fan blades from contacting the deforming case, the tip clearance between fan and case must be carefully selected. Tip clearance is, however, closely related to fan performance, and hence room for design improvement exists.

SUMMARY

In one aspect, there is provided a turbofan engine comprising an axially extending annular inner wall surrounding tips of rotatable fan blades of the turbofan engine, a layer of insulating material surrounding the inner wall, an outer casing including an axially extending annular outer wall surrounding the insulating material and concentric to the inner wall, a plurality of intersecting outer ribs extending radially outwardly from the outer wall in an isogrid configuration and defining a support structure extending from a location forward of the blade tips to a location aft of the blade tips, and at least two annular rub elements extending radially inwardly from the outer wall through only a portion of a radial thickness of the layer of insulating material, at least two of the rub elements being in axial alignment with the blade tips at every point around a circumference of the fan, each rub element having a radially inner end spaced apart from the inner wall and composed of a material harder than that of the blades, and a containment fabric layer wrapped around the support structure.

In another aspect, there is provided a fan case for a turbofan engine comprising an annular inner wall surrounding tips of a set of fan blades mounted for rotation about a central axis of the engine and extending axially from a first location fore of the fan blades to a second location aft of the fan blades, an annular outer wall concentric to the inner wall and interconnected thereto by front and aft circumferential flanges located respectively fore and aft of the fan blades, the interconnected inner and outer walls defining an annular enclosure therebetween bounded by the front and aft circumferential flanges, at least two annular inner ribs extending radially inwardly from the outer wall and configured such that at least two of the inner ribs are in axial alignment with the tips of the fan blades at every point around a circumference of the outer wall, the inner ribs extending from the outer wall across only part of a radial height of the enclosure, and a material harder than that of the fan blades at least covering the radially inner end of each inner rib, an acoustic material filling the enclosure, and a high-strength woven fibrous material wrapped around a plurality of intersecting outer ribs extending radially outwardly from the outer wall, the intersecting outer ribs forming a support structure supporting the fibrous material.

In a further aspect, there is provided an outer casing for a fan case of a turbofan engine having a blade region in axial alignment with tips of rotating fan blades of the engine, the casing comprising an axially extending annular wall, a plurality of intersecting outer ribs extending radially outwardly from the wall in an isogrid configuration and defining a support structure extending from a location forward of the blade region to a location aft of the blade region, and at least two axially spaced apart circumferential annular rub elements extending radially inwardly from the wall within the blade region, each rub element extending from an inner surface of the wall along a radial height and having an axial thickness smaller than the radial height, each rub element having at least a radially inner end made of a material harder than that of the wall and that of the blades.

DESCRIPTION OF THE DRAWINGS

Reference is now made to the accompanying figures in which.

DETAILED DESCRIPTION

Figure 1:
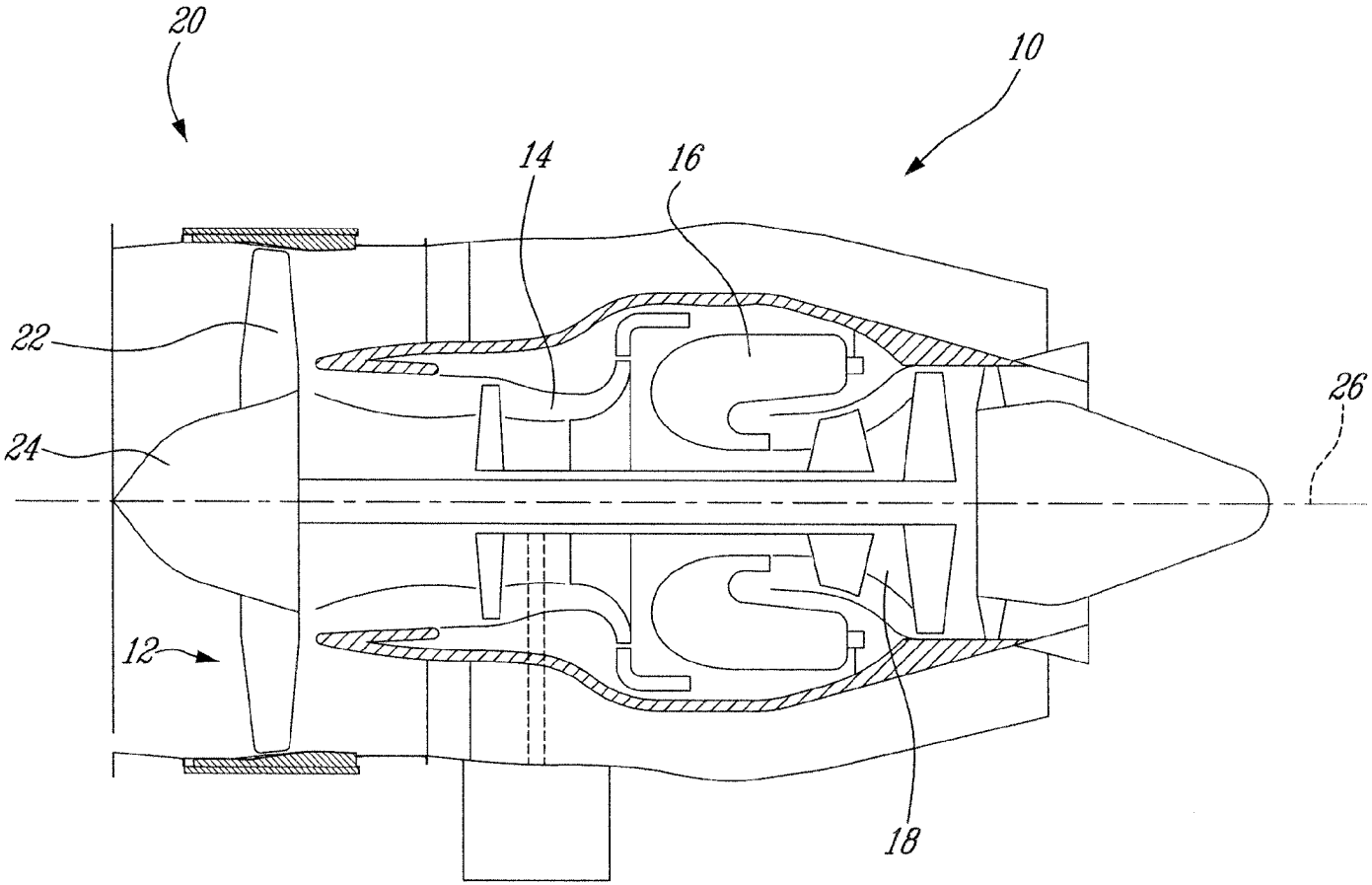
FIG. 1 is a schematic cross-sectional view of a turbofan gas turbine engine including a fan case having a blade containment structure.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The fan 12 includes a fan case 20 surrounding a circumferential array of fan blades 22 extending radially outwardly from a rotor 24 mounted for rotation about the central axis 26 of the engine 10.

The fan case 20 has an annular softwall sandwiched structure designed for containing blade fragments or blades in the event of a blade-out incident during engine operation. As will be seen herein after, the present design allows for minimizing the outside diameter and the weight of the fan case 20 while still providing for the required blade containment capability.

Figure 2:
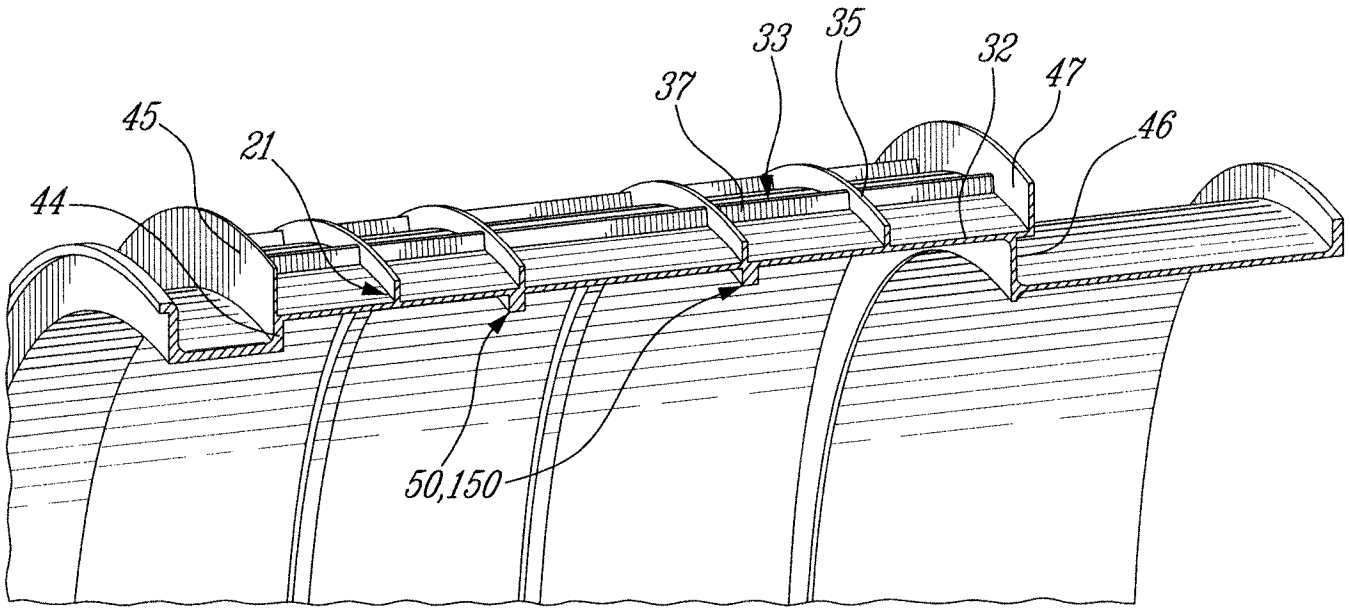
FIG. 2 is a perspective view of a portion of the fan case shown in FIG. 1.

Referring to FIG. 2, the fan case 20 comprises an outer casing 21, which includes an annular outer wall 32 and an outer support structure 33 extending from an outer surface thereof. In the embodiment shown, the outer support structure 33 has an isogrid configuration, including a plurality of circumferentially extending ribs 35 integrally intersecting a plurality of equally spaced apart axially extending ribs 37. The support structure 33 is bounded by front and rear outer circumferential flanges 45, 47, located respectively front and aft of the fan blades 22, and to which the axial ribs 37 are connected. A blade release region is thus defined between the front and rear outer flanges 45, 47, where released blades and blade fragments may be directed. The spacing of the ribs 35, 37 is selected such as to direct released blades and blade fragments through the outer wall 32. In a particular embodiment, at least 6 and at most 24 equally spaced apart axial ribs 37 are provided. In the embodiment shown, 12 equally spaced apart axial ribs 37 are provided.

The outer wall 32 and support structure 33 can be made of steel, aluminum, titanium or other lightweight high-strength metal alloys, or alternately be made of composite materials.

Although the isogrid pattern of the outer support structure 33 is shown with circumferential and axial ribs, in an alternate embodiment, the intersecting ribs form a different pattern which may be angled with respect to the axial direction and/or the circumferential direction, for example a triangular pattern where the ribs intersect each other at an angle of 60°, or a rectangular pattern where the ribs intersect perpendicularly but extend at an angle of 45° with respect to the axial and circumferential directions.

The outer casing 21 also includes front and rear inner flanges 44, 46 extending radially inwardly from the outer wall 32, located respectively front and aft of the rotating fan blades 22 and aligned with or in proximity of, respectively, the front and rear outer flanges 45, 47. The outer casing 21 further includes rub elements 50, 150 extending from an inner surface of the outer wall 32, which will be further detailed below.

Figure 3:
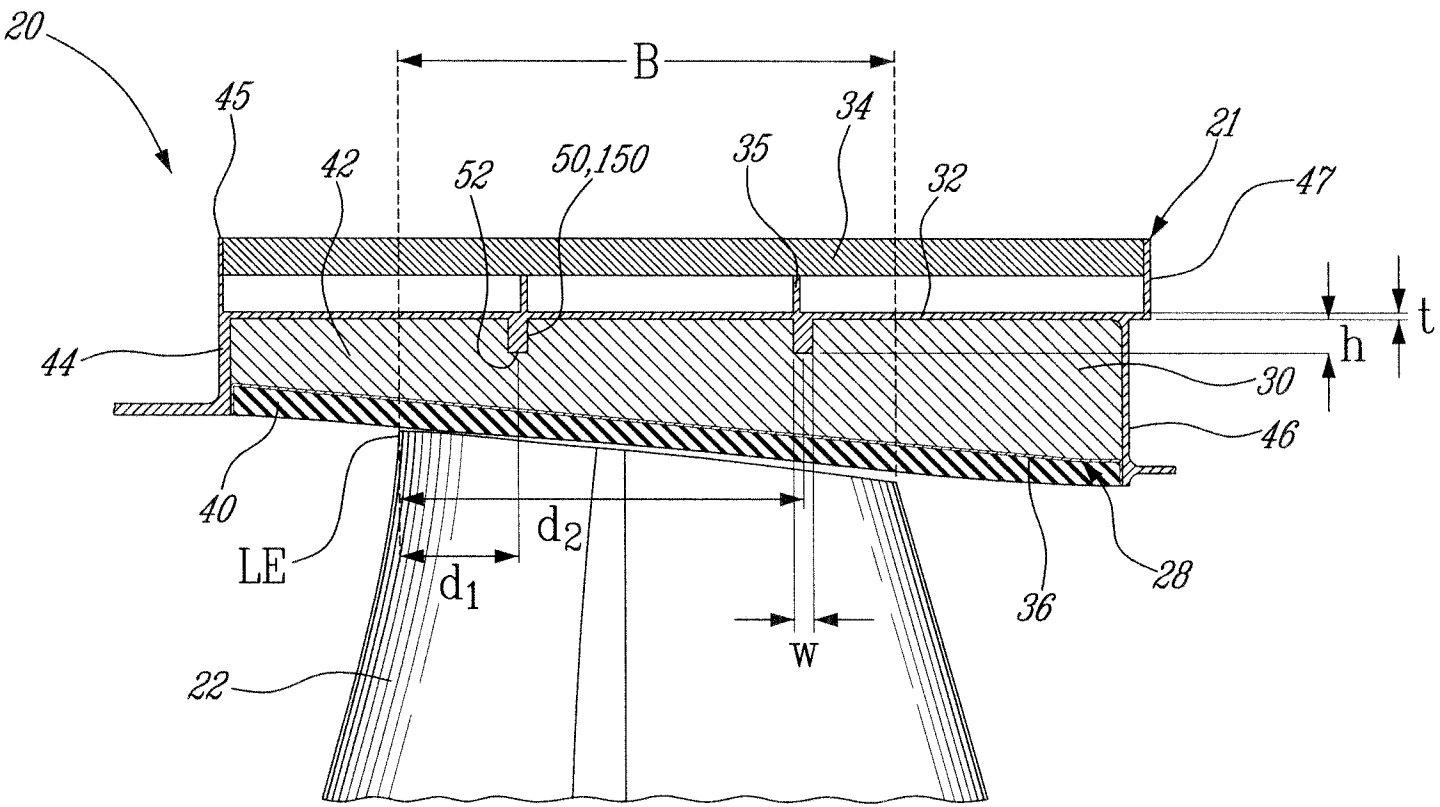
FIG. 3 is a detailed schematic cross-sectional view of a portion of the fan case shown in FIG. 1.

Referring to FIG. 3, the fan case 20 also includes an inner wall 28 extending concentrically with and inside of the outer wall 32, and bonded or otherwise secured to the front and rear flanges 44, 46. The radially inner side 36 of the inner wall 28 constitutes the innermost surface of the fan case 20 and closely surrounds the tips of the blades 22 while extending axially fore and aft of the blades 22. The inner wall 28 can also be made of steel, aluminum, titanium or other lightweight high-strength metal alloys, or alternately be made of composite materials.

In the illustrated example, the inner wall 28 is provided in the form of an axially extending annular part, with radially inwardly curved front end rear ends. As such, the radially inner side 36 of the inner wall 28 defines a tray for receiving an abradable tip clearance control layer 40 in axial alignment with the tips of the blades 22, in order to enable close tolerances to be maintained between the blade tips and the radially inner side 36 of the inner wall 28. The abradable tip clearance control layer 40 is made of an abradable material which helps define an optimal tip clearance for the fan blades 22 during use. The abradable layer 40 can be made from any suitable abradable coating material such as 3M's Scotch Weld™ or a similar and/or functionally equivalent epoxy based abradable compound.

The fan case 20 also comprises a layer of insulating/energy absorbing material 30, such as a honeycomb material, which is received in the enclosure 42 formed between the inner and outer walls 28, 32 and bounded by the front and rear inner flanges 44, 46. In the embodiment shown, the material 30 completely fills the enclosure 42 and extends continuously from the front end of the enclosure 42 to the rear end thereof, thereby fully axially spanning the tips of the blades 22. The material 30 is bonded or otherwise suitably secured to the radially outer side of the inner wall 28 and the radially inner side of the outer wall 32. The material 30 provides for small blade fragments retention and kinetic energy absorption, and also plays a structural role in contributing to stiffen/reinforce the fan case assembly and can utilize varying densities at specific locations as structurally or acoustically required. The material 30 provides a load path to transfer structural loads from the inner wall 28 to the outer wall 32 and vice versa.

The material 30 can be provided in the form of an acoustic material. In this case, the material also provides for acoustic damping. For instance, a honeycomb foam composite (HFC) material could be used. The honeycomb material can be metallic or non-metallic. For instance, the following two products manufactured by Hexcel Corporation could be used: aluminum honeycomb CR-PAA/CRIII or non-metallic honeycomb HRH-10. The honeycomb material may be composed of multiple pieces in order to provide added acoustical treatment or improved localized stiffness. Acoustic material not in honeycomb configuration may alternately be used in the layer of lightweight insulating/energy absorbing material 30.

The fan case 20 also comprises a containment fabric layer 34 which surrounds the casing 21 and is disposed over the ribs 35, 37 of the support structure 33, from the front outer flange 45 to the rear outer flange 47. The spacing of the ribs 35, 37 is thus also selected such as to provide sufficient support for the containment fabric layer 34. The containment fabric layer 34 may include aromatic polyamide fabric such as Kevlar®, which has a relatively light weight and high strength. Other high-strength woven fibrous materials (e.g. ballistic type fabrics) could be used as well. Any suitable reinforcing fibres can be used in the containment material including, but not limited to, glass fibres, graphite fibres, carbon fibres, ceramic fibres, aromatic polyamide fibres (also known as aramid fibres), for example poly(p-phenyletherephtalamide) fibres (Kevlar® fibres), and mixtures thereof. Any suitable resin can be used in the containment fabric layer 34, for example, thermosetting polymeric resins such as vinyl ester resin, polyester resins, acrylic resins, polyurethane resins, and mixture thereof.

The annular rub elements 50, 150 of the outer casing 21 extend radially inwardly from the outer wall 32, within the enclosure 42. As least two spaced apart annular rub elements 50, 150 are provided, such as to intercept the tip of the blades before they rub against the outer wall 32 and also direct the released blades and blade fragments between the ribs 35, 37 of the support structure 33 to penetrate the outer wall 32 and be retained by the containment layer 34. The rub elements 50, 150 are positioned to direct the released blade or blade fragment toward the middle of the axial length of the containment layer 34, to prevent the released blade or blade fragment from escaping from the front or rear edge of the containment layer 34.

In the embodiment shown, two circumferentially aligned rub elements 50, 150 are provided within a blade region B of the outer wall 32 defined in axial alignment with the blade tips. In a particular embodiment, the first rub element 50, 150 is located at a distance $d_1$ from the leading edge LE of the blade which corresponds to at least 5% and at most 30% of the axial chord length of the blade, while the second rub element 50, 150 is located at a distance $d_2$ from the leading edge LE of the blade which corresponds to at least 70% and at most 95% of the axial chord length of the blade. In the embodiment shown, each of the rub elements 50, 150 is in alignment with a respective circumferential rib 35 of the outer support structure 33, in order to facilitate load transfer from the rubbing blades through the outer support structure 33 and ultimately to the engine mount. The rub elements 50, 150 also play a role in preventing axial cracks in the outer wall 32 from extending across the length thereof.

Still referring to FIG. 3, the rub elements 50, 150 of the casing 21 extend radially from the outer wall 32 along only part of the radial dimension of the enclosure 42. As such their radially inner end 52 is spaced apart from the inner wall 28. In a particular embodiment, the rub elements 50, 150 extend from the inner surface of the outer wall 32 along a radial height h which is from 2 to 3 times the thickness t of the outer wall 32, and have an axial width w which is from 1 to 2 times the thickness t of the outer wall 32. In any event, the rub elements 50, 150 are sized such as to avoid plasticizing when the blade tip rubs thereagainst.

In order to resist rubbing from the tip of the blades 22 so as to prevent rubbing thereof against the outer wall 32, at least the radially inner end 52 of each rub element 50, 150 is made of a material which is harder than the material of the fan blade 22. For example, if the blades 22 are made of titanium (e.g. Young's modulus of approximately $16\times10^6$ psi) and the outer wall 32 is made of aluminum or composite material (e.g. Young's modulus of approximately $10\times10^6$ psi), the outer wall 32 is not adapted to resist the rubbing of the blades which happen upon blade damage and until the blades 22 stop rotating. By having at least the radially inner end 52 of the rub elements 50, 150 made of a material harder than that of the blades 22, for example steel (e.g. Young's modulus of approximately $30\times10^6$ psi), the radially inner ends 52 of the rub elements 50, 150 are adapted to resist the rubbing of the blades 22 until the rotor rotation stops, preventing the blades 22 from rubbing against the outer wall 32, and against the containment layer 34.

Figure 4:
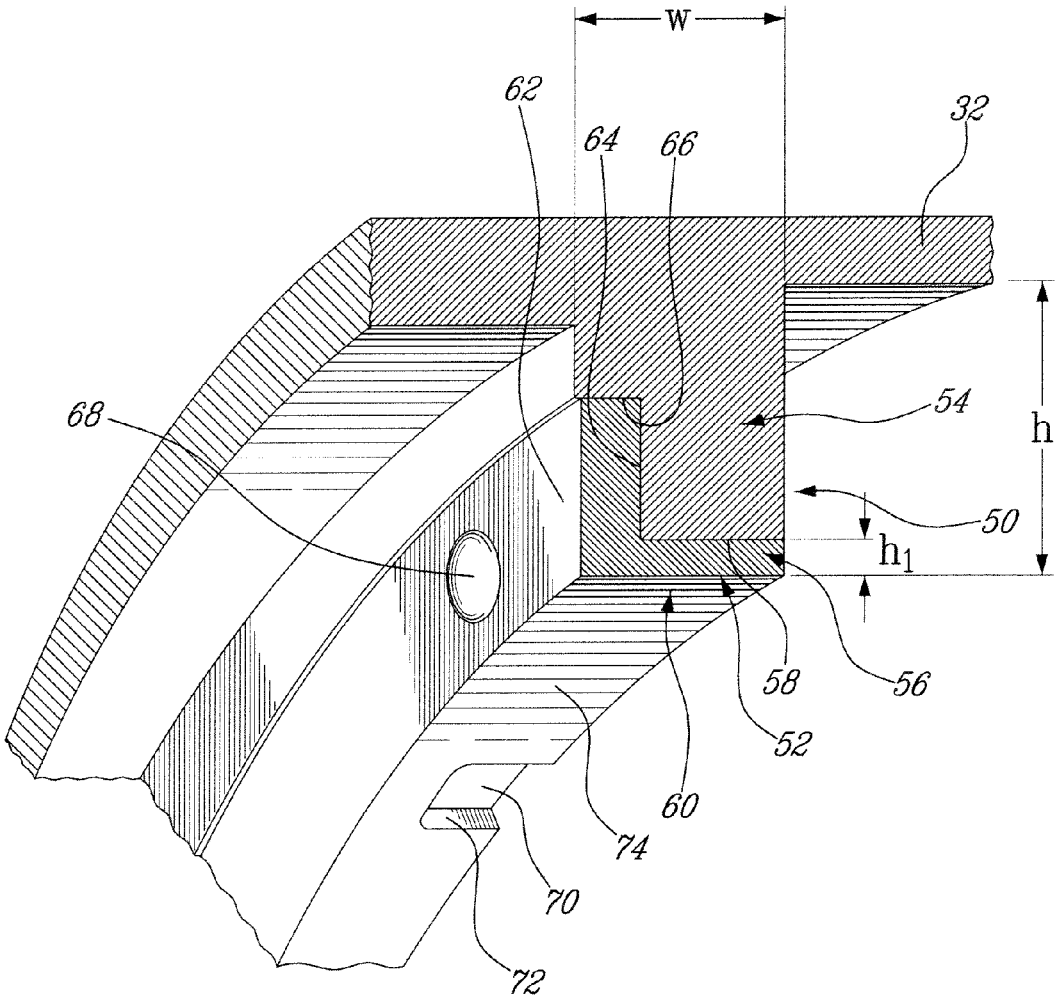
FIG. 4 is a three dimensional cross-sectional view of a rub element of the fan case of FIGS. 2-3.

Referring to FIGS. 3-4 an exemplary embodiment of the rub element 50 is shown. The rub element 50 includes a radially extending annular rib 54 defining the width w of the rub element 50. In the embodiment shown, the rib 54 is integral with the outer wall 32, i.e. the outer wall 32 and rib 54 are part of the same monolithic element. As such, the rib 54 is made of the same material as that of the outer wall 32. Alternately, the rib 54 can be formed separately from the outer wall 32 and subsequently attached thereto using any adequate fastening method.

The rub element 50 also includes an annular strip 56 which defines the inner end 52 of the element 50. The strip 56 has an L-shaped cross-sectional profile, formed by an axial leg 60 which is disposed against a radially inner surface 58 of the rib 54, and a radial leg 62 which is disposed against a radial surface 64 of the rib 54. The cross-sectional profile of the rib 54 is complementary to that of the strip 56, such that once assembled the rub element 50 is defined with a rectangular cross-section. In a particular embodiment, the radial surface 64 of the rib 54 is machined to remove a thickness of material approximately equal to that of the radial leg 62, and along a radial dimension corresponding to the length of the radial leg 62. As such, the radial leg 62 of the strip 56 abuts an axially extending shoulder 66 defined in the rib 54 when the axial leg 60 of the strip 56 rests against the radial surface 64 of the rib 54. Alternate adequate cross-sectional shapes are also possible for the rub element, rib and/or strip, e.g. a rub element having a T-shaped cross-sectional profile, as long as the strip is shaped to define at least the radially inner end of the rub element.

Figure 5:
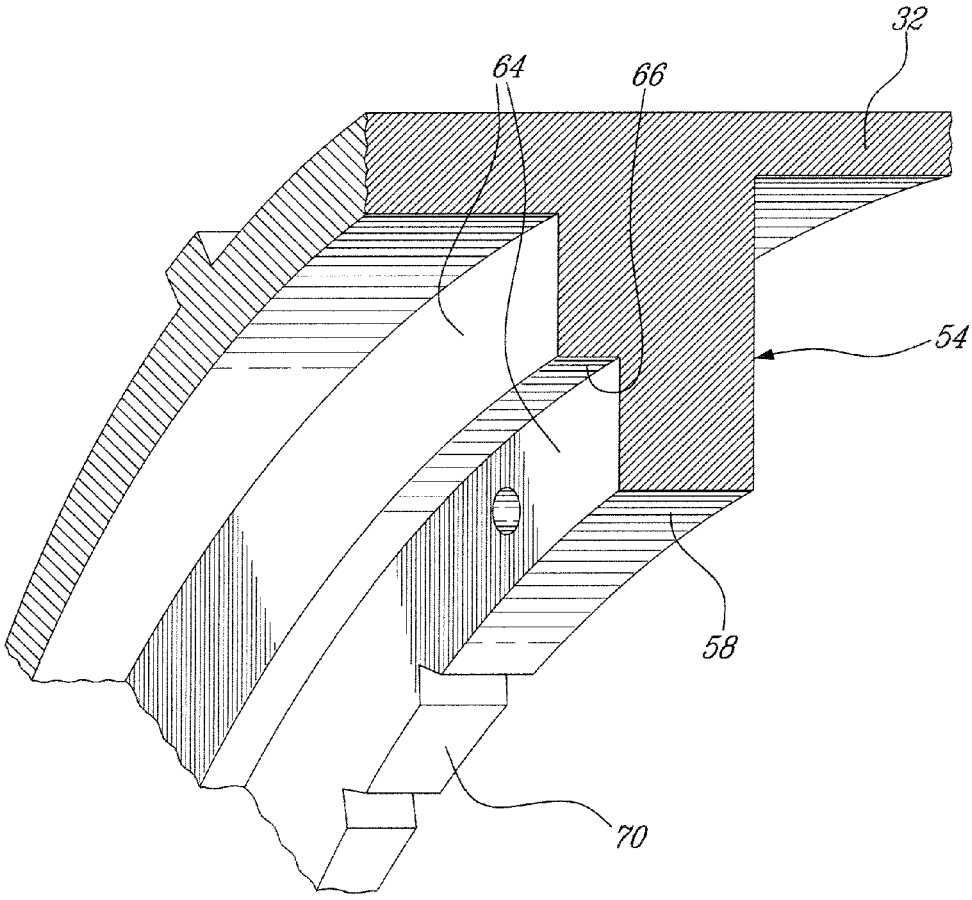
FIG. 5 is a three dimensional cross-sectional view of part of the rub element of FIG. 4.

The strip 56 and rib 54 are interconnected by axially oriented rivets 68 (only one of which is shown) extending through the radial leg 62 and the rib 54. Additional anti-rotation features may also be provided, such as a series of tongues 70 (see FIG. 5, only one of which is shown) defined in the radially inner surface 58 of the rib 54, which each engage a respective complementary slot 72 (FIG. 4, only one of which is shown) defined in the axial leg 60 of the strip 56. Alternate configurations for anti-rotation features are also possible, or the anti-rotation features may be omitted if the rivets 68 provide adequate anti-rotation protection.

The radial leg 62 of the strip 56 performs mainly a retaining function, providing a surface which is used to attach the strip 56 to the rib 54. The interfering function of the rub element 50 is mainly performed by the axial leg 60 of the strip 56, against which the tip of the blades 22 may rub and substantially lose energy. The fraction of the radial height h of the rub element 50 which is defined by the height $h_1$ of the strip 56 is selected based on the material of the strip 56, and on the size (power and speed) of the engine. The height $h_1$ of the strip 56 is selected such that the strip 56 is able to withstand blade rubbing until the blade rotation stops.

As such, at least the outer surface 74 of the axial leg 60 is made of a material harder than that of the fan blade 22. In a particular embodiment, the strip 56 is monolithic and entirely made of the material harder than that of the fan blade 22. In an alternate embodiment, the strip 56 includes a core which can be made of the same material as that of the outer wall 32, and an outer coating at least on the outer surface 74 of the axial leg 60 which is made of a material harder than that of the fan blade 22, the coating having a sufficient thickness to be able to withstand blade rubbing until the blade rotation stops. Such a harder material can be any adequate type of metal or composite compatible with the material of the outer wall 32 and, in the case of a coating, with that of the core of the strip 56. As mentioned above, in a particular embodiment, the outer wall 32 is made of aluminum and the blade of titanium, while the harder material forming at least part of the strip 56 is steel. Alternate combinations of materials are also possible. In cases where the harder material is provided as a coating, the coating may be a plasma spray coating, a suitable hardcoat, or any other suitable coating, for example a nano coating of Nickel or Cobalt.

Figure 6:
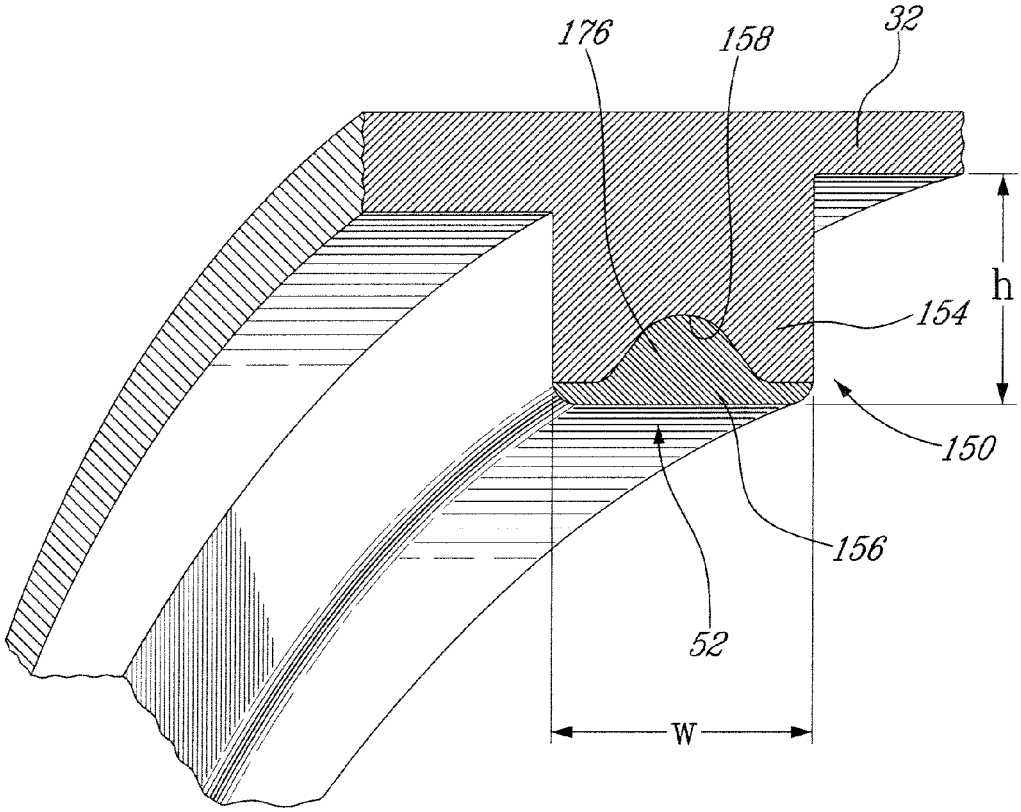
FIG. 6 is a three dimensional cross-sectional view of an alternate rub element of the fan case of FIGS. 2-3.

Referring to FIG. 6, an alternate embodiment of the rub element 150 is shown. The rub element 150 includes a radially extending annular rib 154, which in the embodiment shown is integral with the outer wall 32, i.e. the outer wall 32 and rib 154 are part of the same monolithic element. As such, the rib 154 is made of the same material as that of the outer wall 32. The rib 154 includes a circumferential groove 176 which is defined in a radially inner surface 158 thereof. The rub element 150 also includes an outer coating 156 on the radially inner surface 158 of the rib 154, which also fills the groove 176. The outer coating 156 thus defines the inner end 52 of the rub element 150, and is made of a material harder than that of the fan blade 22, and has a thickness sufficient to be able to withstand blade rubbing until the blade rotation stops. Such a material can be any adequate type of metal or composite compatible with the material of the outer wall 32. In a particular embodiment, the outer coating is a nano coat, or is formed through a plasma spraying process. In an alternate embodiment, the rib 154 and outer wall 32 are made of aluminum, and the outer coating 156 is a hardcoat.

In an alternate embodiment which is not shown, the rub element is completely made of the material harder than that of the fan blade 22, and extends directly from the outer wall 32. The rub element may have for example a shape similar to that of one of the rub elements 50, 150 shown and described above.

In another alternate embodiment which is not shown, the rub elements are defined by an isogrid structure extending radially inwardly from the outer wall, with integrally intersecting ribs which may be oriented axially and circumferentially, or alternately ribs angled with respect to the axial direction and/or the circumferential direction, for example ribs intersecting each other in a triangular pattern at an angle of 60°, or ribs intersecting each other perpendicularly but extending at an angle of 45° with respect to the axial and circumferential directions. The radially inner end of the rub elements are defined by a coating on the radially inner surfaces of the ribs, the coating being made of a material which is harder than that of the fan blades, and having a thickness sufficient to be able to withstand blade rubbing until the blade rotation stops, similarly to the coating of the rub elements 150 described above. The rub elements are located such that at least two of the rub elements 50, 150 are in axial alignment with the blade tips at every point around a circumference of the fan, i.e. such that at least two of the rub elements are located or pass through the blade region B at every circumferential location thereof.

The softwall fan case design described above is relatively light weight, compact, while providing a cost effective blade containment system and good vibration and sound damping structure over hard walled and softwall fan case designs.

The presence of the rub elements 50, 150, which provide an intermediate surface against which the tips of the blades rub until the blade rotation stops to prevent rubbing against the outer wall 32, allow for the clearance between the blade tip and the outer wall 32 to be smaller, thus resulting in a reduction of the outer wall diameter. The reduced risk of penetration of the blade tip through the outer wall 32 also allows for a reduction of the thickness of the containment fabric layer 34. As such, the outer diameter of the fan case 20 may be reduced. Also, the proximity of the inner and outer walls 28, 32 allow for a reduction of the radial dimension of the enclosure 42, and as such of the quantity of insulating/energy absorbing material 30 contained therein. This, along with the reduction in outer diameter of the fan case 20 and thickness reduction of the containment fabric layer 34, contribute to minimization of the fan case weight.

The above description is meant to be exemplary only, and one skilled in the art will recognize that changes may be made to the embodiments described without departing from the scope of the invention disclosed. It is to be understood that the materials and other properties of each of the layers of the fan case can vary depending on a number of design factors, including engine size and configuration for example. Still other modifications which fall within the scope of the present invention will be apparent to those skilled in the art, in light of a review of this disclosure, and such modifications are intended to fall within the appended claims.

The invention claimed is:

1. A turbofan engine comprising:

an axially extending annular inner wall surrounding tips of rotatable fan blades of the turbofan engine;

a layer of insulating material surrounding the inner wall;

an outer casing including an axially extending annular outer wall surrounding the insulating material and concentric to the inner wall, a plurality of intersecting outer ribs extending radially outwardly from the outer wall in an isogrid configuration and defining a support structure extending from a location forward of the blade tips to a location aft of the blade tips, and at least two annular rub elements extending radially inwardly from the outer wall through only a portion of a radial thickness of the layer of insulating material, at least two of the rub elements being in axial alignment with the blade tips at every point around a circumference of the fan, each rub element having a radially inner end spaced apart from the inner wall and composed of a material harder than that of the blades; and a containment fabric layer wrapped around the support structure.

2. The turbofan engine as defined in claim 1, wherein the at least two annular rub elements include two spaced apart circumferential rub elements oriented along a circumferential direction of the outer casing.

3. The turbofan engine as defined in claim 2, wherein the two spaced apart circumferential rub elements include a first rub element in an axial position located at least 5% and at most 30% of an axial chord length of the blade aft from a leading edge of the blade tips, and a second rub element in an axial position located at least 70% and at most 95% of the axial chord length aft from the leading edge.

4. The turbofan engine as defined in claim 1, wherein each rub element extends from an inner surface of the outer wall along a radial height, and has a thickness smaller than the radial height and defined perpendicularly thereto.

5. The turbofan engine as defined in claim 4, wherein the radial height of each rub element measured from the inner surface of the outer wall is at least twice and at most three times a radial thickness of the outer wall.

6. The turbofan engine as defined in claim 5, wherein the thickness of each rub element is at least equal and at most twice the radial thickness of the outer wall.

7. The turbofan engine as defined in claim 1, wherein each rub element includes an annular rib extending radially inwardly from the outer wall and an annular strip having at least an outer surface composed of the material harder than that of the blades and detachably connected to the rib to define the radially inner end.

8. The turbofan engine as defined in claim 7, wherein each strip has an L-shaped cross-section, including an axial leg defining the radially inner end of the rub element and a radial leg extending from the axial leg and disposed against a radial surface of the rib, the strip being detachably connected to the rib through the radial leg.

9. The turbofan engine as defined in claim 7, wherein each strip is a monolithic element composed of the material harder than that of the blades.

10. The turbofan engine as defined in claim 1, wherein each rub element includes an annular rib extending radially inwardly from the outer wall and an outer coating deposited directly on the rib to form the radially inner end thereof, the coating being composed of the material harder than that of the blades.

11. The turbofan engine as defined in claim 10, wherein the coating is a plasma spray coating, a hardcoat, a nano coating of Nickel or a nano coating of Cobalt.

12. The turbofan engine as defined in claim 1, wherein the material harder than that of the blades is harder than titanium.

13. The turbofan engine as defined in claim 1 wherein the material harder than that of the blades is also harder than that of the inner and outer walls.

14. A fan case for a turbofan engine comprising:

an annular inner wall surrounding tips of a set of fan blades mounted for rotation about a central axis of the engine and extending axially from a first location fore of the fan blades to a second location aft of the fan blades;

an annular outer wall concentric to the inner wall and interconnected thereto by front and aft circumferential flanges located respectively fore and aft of the fan blades, the interconnected inner and outer walls defining an annular enclosure therebetween bounded by the front and aft circumferential flanges;

at least two annular inner ribs extending radially inwardly from the outer wall and configured such that at least two of the inner ribs are in axial alignment with the tips of the fan blades at every point around a circumference of the outer wall, the inner ribs extending from the outer wall across only part of a radial height of the enclosure, and a material harder than that of the fan blades at least covering the radially inner end of each inner rib;

an acoustic material filling the enclosure; and a high-strength woven fibrous material wrapped around a plurality of intersecting outer ribs extending radially outwardly from the outer wall, the intersecting outer ribs forming a support structure supporting the fibrous material.

15. The fan case as defined in claim 14, wherein the at least two annular inner ribs include two spaced apart circumferential ribs oriented along a circumferential direction of the outer wall.

16. The fan case as defined in claim 15, wherein the two spaced apart circumferential ribs include a first rib in an axial position located at least 5% and at most 30% of an axial chord length of the blade aft from a leading edge of the blade tips, and a second rib in an axial position located at least 70% and at most 95% of the axial chord length aft from the leading edge.

17. The fan case as defined in claim 14, wherein each inner rib extends from an inner surface of the outer wall along a radial height of at least twice and at most three times a radial thickness of the outer wall, and has a thickness smaller than the radial height and defined perpendicularly thereto.

18. The fan case as defined in claim 14, wherein an annular strip is detachably connected to the radially inner end of each inner rib, the annular strip having at least an outer surface composed of the material harder than that of the blades.

19. The fan case as defined in claim 14, the material harder than that of the blades is in the form of an outer coating deposited directly on at least the radially inner end of each inner rib.

20. An outer casing for a fan case of a turbofan engine having a blade region in axial alignment with tips of rotating fan blades of the engine, the casing comprising an axially extending annular wall, a plurality of intersecting outer ribs extending radially outwardly from the wall in an isogrid configuration and defining a support structure extending from a location forward of the blade region to a location aft of the blade region, and at least two axially spaced apart circumferential annular rub elements extending radially inwardly from the wall within the blade region, each rub element extending from an inner surface of the wall along a radial height and having an axial thickness smaller than the radial height, each rub element having at least a radially inner end made of a material harder than that of the wall and that of the blades.

* * * * *